US005222516A

United States Patent [19]

Schröcker

[11] Patent Number: 5,222,516

[45] Date of Patent: Jun. 29, 1993

[54] VALVE SEAT PLATE FOR PISTON COMPRESSOR

[75] Inventor: Helmut Schröcker, Schwabbruck, Fed. Rep. of Germany

[73] Assignee: Hoerbiger Ventilwerke Aktiengesellschaft, Vienna, Austria

[21] Appl. No.: 814,804

[22] Filed: Dec. 31, 1991

[30] Foreign Application Priority Data

Jan. 2, 1991 [AT] Austria ..... 4/91

[51] Int. Cl.[5] ..... F16K 49/00

[52] U.S. Cl. ..... 137/340; 137/512.1; 417/571

[58] Field of Search ..... 417/571; 137/512.1, 137/340

[56] References Cited

U.S. PATENT DOCUMENTS

| | | | |
|---|---|---|---|
| 1,013,067 | 1/1912 | Denker | 137/340 |
| 1,287,530 | 12/1918 | Voss | 137/512.1 |
| 1,638,114 | 8/1927 | Dunlap et al. | 417/571 |
| 1,768,844 | 7/1930 | Holdsworth | 137/512.1 |
| 2,449,408 | 9/1948 | Naab | 137/512.1 |
| 2,935,248 | 5/1960 | Gerteis | 417/571 |
| 4,722,671 | 2/1988 | Azami et al. | 417/571 |

*Primary Examiner*—A. Michael Chambers
*Attorney, Agent, or Firm*—Watson, Cole, Grindle & Watson

[57] ABSTRACT

A valve seat plate (1) having at least three individual plates (2, 3, 4) which lie upon one another and exhibits, on the one hand, continuous channels (5) for the medium to be controlled and defines, on the other hand, cavities (16) between the channels for the coolant, includes sleeves (8) that define the channels and are sealed with respect to the cavities and extend through the thickness of the valve seat plate.

6 Claims, 1 Drawing Sheet

Fig. 1
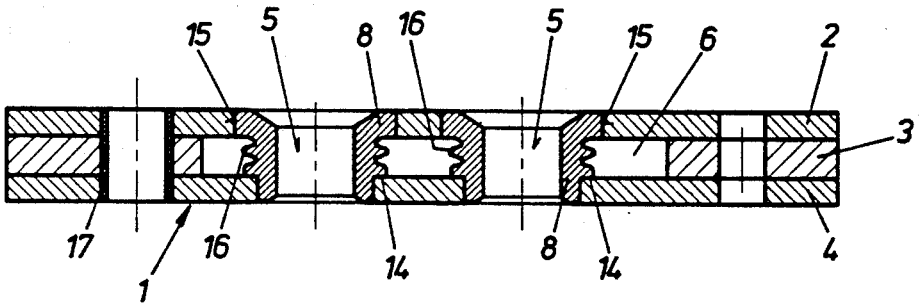
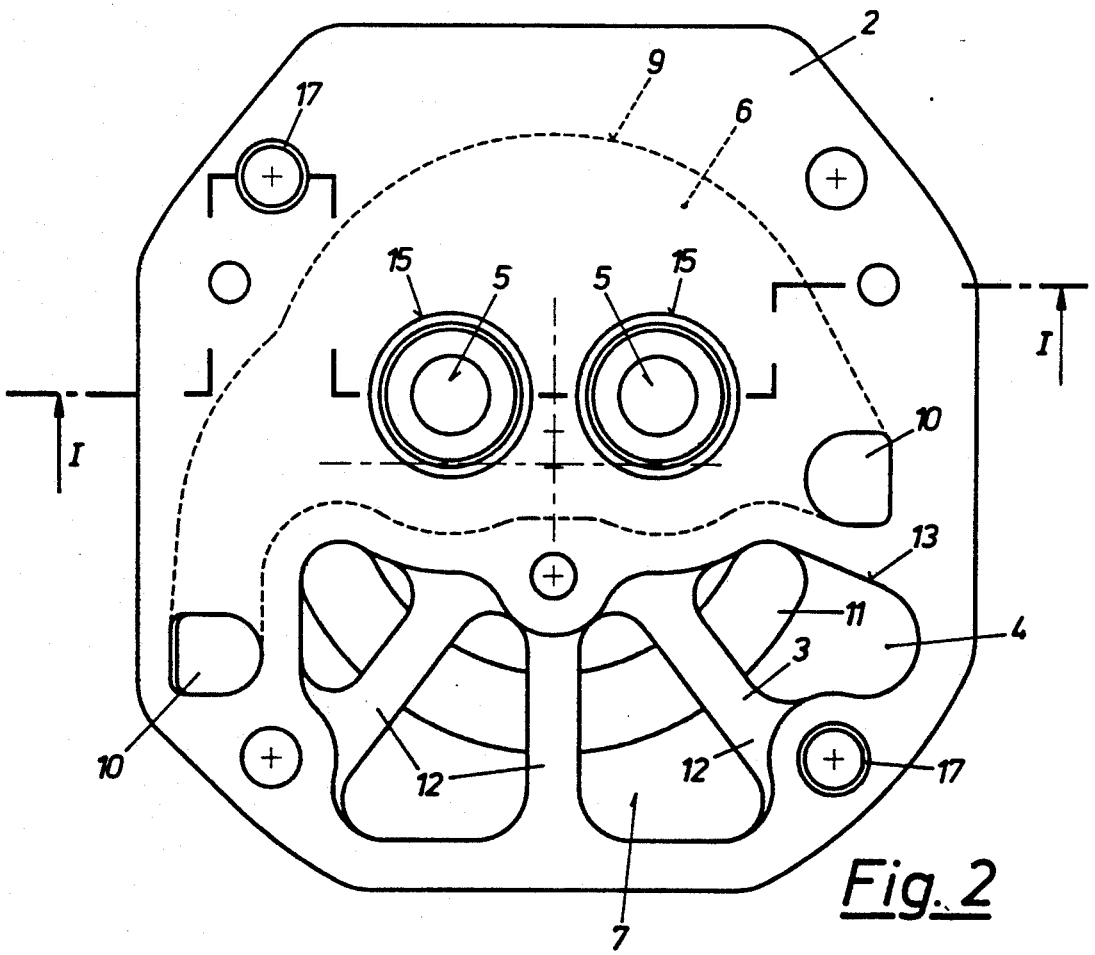
Fig. 2

VALVE SEAT PLATE FOR PISTON COMPRESSOR

BACKGROUND OF THE INVENTION

The invention relates to a valve seat plate, in particular a valve seat plate in a piston compressor, which has at least three individual plates that lie upon one another and provide continuous channels for the medium to be controlled, as well as cavities between the channels for the coolant.

Valve seat plates constructed of several individual plates are known, for example, from the DE-AS 1 142 478 and U.S. Pat. No. 2,449,408, and enable a relatively simple manufacture of the channels or cavities integrated into the seat plate. Whereas in the design according to DE-AS 1 142 478 only channels for the medium to be controlled are formed with the aid of the suitably hollow central plate, in U.S. Pat. No. 2,449,408 cooling chambers or channels are also defined between the individual plates. In order to ensure both the free passage of all channels or cavities and the reliable seal of the channels or cavities among each other, an increased cost in assembly results because it is usually necessary to separately fix all of the parts that lie in the central region which are not connected to the outer individual plates. Following the connection of the individual plates, for example, by soldering, the accurate positioning can be checked only with great effort. In addition, with respect to the aforementioned requirements, at least all of the parts lying in the central region must be toleranced or sorted together with fine precision.

To date the described difficulties have been usually avoided by pouring such valve seat plates in one piece by means of a Croning core for the cavities, which results in cavity limits in the pouring practice and high costs of inspection and cleaning.

The object of the present invention is to improve on a valve seat plate of the aforementioned kind in such a way that the cited drawbacks of such known constructions are avoided and that in an especially simple and easy to install manner, a valve seat plate is created in which the correct positioning of the individual plates and their sealing in the flow region is facilitated and improved.

SUMMARY OF THE INVENTION

This problem is solved with the present invention in that the channels are disposed in sleeves that are sealed with respect to the cavities and extend through the thickness of the valve seat plate. In this manner the subassemblies defining the channels are automatically positioned in the correct position. Another advantage with punched individual plates lies in the fact that the thickness tolerance of the punched center piece is not dependent on a separate part for the pressure medium boreholes. With respect to the seal in the flow region, the continuous channels for the medium to be controlled are independent of any offsetting of the individual plates and of the quality of the connection, e.g., of the soldering. The individual subassemblies of the valve seat plate can be made of material adapted to their respective function or manufacture, thus enabling a variety of combinations.

Furthermore, the wall thicknesses of the inserted sleeves for the channels are significantly thinner than, for example, in a design poured in one piece, so that the heat transfer conditions are improved. All individual subassemblies of the valve seat plate can be designed in such a manner that following connection the finishing does not require any more machining.

Another embodiment of the invention provides that the central individual plate(s) is/are hollow in the region of the sleeves to form cavities for the coolant and that the sleeves exhibit shoulders to brace and accurately position the outer individual plates. This design facilitates the fitting of individual parts of the valve seat plate, on the one hand, and enables a dimensioning of the cavities for the coolant that is virtually independent of the dimensioning of the channels.

In another preferred embodiment of the invention the sleeves can exhibit an enlarged heat transfer surface, preferably rib-shaped outer contours in the region of the cavities. Together with the aforementioned possibility of designing the sleeves with thin walls, the result is an especially good dissipation of heat in order to cool those spots that are stressed the most.

Another embodiment of the invention provides that the central individual plates(s) is/are fixed in its/their relative position by means of separate centering elements, preferably inserted sleeves that extend over the thickness of the valve seat plate. Since the channels for the medium to be controlled are guided in the inserted sleeves independently of the central individual plates, the central individual plates or the in any case single central individual plate can be fixed in position in the aforementioned simple manner.

The sleeves and the individual plates can, as already addressed above in general, be made of different materials, a feature that yields a variety of possibilities in order to consider the special stresses and also manufacturing methods.

Finally, an especially preferred embodiment of the invention provides that the sleeves are soldered to the individual plates, a feature that allows sealed and long-lasting connections to be achieved even with a wide range of different materials.

The invention will be explained in detail in the following with the aid of one embodiment shown in the drawings.

BRIEF DESCRIPTION OF THE DRAWINGS

FIG. 1 is a cross section of a valve seat plate according to the invention along the line I—I in FIG. 2; and FIG. 2 is a top view of the valve seat according to FIG. 1.

DETAILED DESCRIPTION OF THE PREFERRED EMBODIMENT

The illustrated valve seat plate 1 for the piston compressor (not shown) or the like exhibits superimposed individual plates 2, 3, 4, which provide continuous channels 5 for the pressure medium to be controlled, a cavity 6 for the coolant, and a suction chamber 7 for the feeding of the compressing medium. Channels 5 are disposed in sleeves 8 which are sealed with respect to the cavity 6 (could also be formed by several cavities that are subdivided and attached to the feed and discharge line for the coolant) and extend through the entire thickness of the valve seat plate and are covered by a spring-loaded valve flap or the like on the upper side in the assembled state of the entire valve (not shown here). Cavity 6 is defined by a suitable recess in the central individual plate 3, and its contour is shown by dashed line 9 in FIG. 2. Cavity 6 is defined by the individual plates 2 or 4 on the upper and bottom side and exhibits in the direction of the cylinder head (not shown) overflow openings 10 on the inflow and outflow sides.

On the bottom side in the drawing the suction chamber 7 is defined by the bottom individual plate 4, which exhibits inlet slots 11 that are covered from the bottom side by means of a suitable valve plate in the assembled state of the entire valve. The central individual plate 3 exhibits in the region of the suction chamber 7 three ribs 12. On the upper side the suction chamber 7 is open towards the top in the upper individual plate 2 over an opening, whose contour is denoted as 13 in FIG. 2, and passes over usually directly into an attached suction line (not shown here) or the like.

Thus, the central individual plate 3 is hollow in the region of the sleeve 8 for the channels 5 carrying the pressure medium, forming cavity 6, where the sleeves 8 exhibit here in the region of their lower end shoulders 14 to support and accurately position the bottom individual plate 4. The region of the upper individual plate 2 has enlarged boreholes 15 which permit the sleeves 8 and the shoulders 14 to be inserted from the top side. In the region of the cavity 6 or optionally of the individual cavities 6, the sleeves 8 have an enlarged heat transfer surface on the outside, e.g., preferably a rib-shaped outer contour 16.

The central individual plate 3 is fixed in its relative position by means of inserted, separate sleeves 17 that extend through the thickness of the valve seat plate 1, where, as a consequence of the independence of this fixing into position of the design of the channels 5 in the sleeves 8 no special accuracy in this connection is necessary.

The sleeves 8 can be made of material that is different from that of the individual plates 2, 3, 4 and is soldered to the individual plates 2, 4, a feature that permits different requirements imposed on the choice of material to be taken into consideration.

Owing to the possibility of designing the wall thickness of sleeves 8 relatively thin and increasing the surface relative to the coolant flow through the shape of the outer contour 16 of the sleeves, the performance of the valve (delivery rate/final pressures) can be increased in total - the higher temperatures can be easily dissipated by means of the aforementioned improvements and thus controlled.

Apart from the illustrated design of the centering or support of the sleeves 8 in the upper and the bottom individual plate 2, 4, these subfunctions can also be interchanged, of course, or provided on both sides. Similarly the central individual plate 3 or several such individual plates can be fixed in position differently than with the illustrated sleeves 17.

I claim:

1. A valve seat plate which comprises first, second and third plates sandwiched together such that said second plate si between said first and third plates, said second plate defining an internal recess which is enclosed by said first and third plates to thereby define a coolant cavity within said valve seat plate, said first and third plates including aligned openings, and a sleeve means which extends between and through said aligned openings and through said cooling cavity, said sleeve means defining a continuous internal channel through which a medium to be controlled can flow.

2. A valve seat plate as claimed in claim 1, wherein said sleeve means includes an outer shoulder which contacts said third plate for alignment of said third plate relative to said first plate.

3. A valve seat plate as claimed in claim 2, wherein said sleeve means provides external ribs which extend into said coolant cavity to facilitate heat transfer to coolant in the coolant cavity.

4. A valve seat plate as claimed in claim 2, including a plurality of centering elements which extend through said first, second and third plates to position said second plate relative to said first and third plates.

5. A valve seat plate as claimed in claim 1, wherein said sleeve means and said plates are made of different materials.

6. A valve seat plate as claimed in claim 5, wherein said sleeve means is soldered to said first and third plates.

* * * * *